United States Patent [19]

Zhukov et al.

[11] Patent Number: 4,480,820

[45] Date of Patent: Nov. 6, 1984

[54] METHOD OF LINING METALLURGICAL ASSEMBLY

[75] Inventors: Leonid F. Zhukov; Evgeny G. Chugunny; Vladimir S. Shumikhin; Sergei V. Kucherenko, all of Kiev; Mechislav V. Zhelnis; Pranas V. Zemlyavichus, both of Kaunas, all of U.S.S.R.

[73] Assignee: Institut Problem Litia Akademii Nauk Ukrainskoi SSR, Kiev, U.S.S.R.

[21] Appl. No.: 451,143

[22] PCT Filed: Mar. 31, 1981

[86] PCT No.: PCT/SU81/00031

§ 371 Date: Nov. 19, 1982

§ 102(e) Date: Nov. 19, 1982

[87] PCT Pub. No.: WO82/03451

PCT Pub. Date: Oct. 14, 1982

[51] Int. Cl.[3] ..... F27D 1/16

[52] U.S. Cl. ..... 266/44; 266/281

[58] Field of Search ..... 266/281, 44, 280, 286, 266/283; 264/30; 373/164, 155, 137

[56] References Cited

U.S. PATENT DOCUMENTS 3,836,613 9/1974 Granitzki et al. ..... 264/30

FOREIGN PATENT DOCUMENTS 1426135 2/1976 United Kingdom ..... 266/281
2028477 3/1980 United Kingdom ..... 266/281
735384 5/1980 U.S.S.R. ..... 266/281

*Primary Examiner*—L. Dewayne Rutledge
*Assistant Examiner*—S. Kastler
*Attorney, Agent, or Firm*—Lilling & Greenspan

[57] ABSTRACT

The proposed method relates to metallurgy and foundry engineering.

The process of lining a metallurgical assembly, in particular an induction furnace (1) is carried out in the following sequence. First, a bottom (2) is lined using a conventional method, following which a gauge (3) for forming an inner wall of the furnace lining is mounted thereon, and a space (5) provided within the gauge (3) and an induction heater (4) of the furnace (1) is filled with a lining mass (6). The lining mass is filled in layers each having a thickness of 4 to 10 values of said space (5). The layers are compacted by applying periodically repeated blows against the inner surface of the gauge (3). These blows are applied in the direction perpendicular to a plane tangential to said surface of the gauge (3), the interval between the blows being not less than the damping time of free oscillations of the furnace.

The above described method may be used when carrying out rammed lining within coreless induction furnaces.

5 Claims, 7 Drawing Figures

METHOD OF LINING METALLURGICAL ASSEMBLY

BACKGROUND OF THE INVENTION

1. Technical Field

The invention relates to metallurgy and foundry engineering and particularly concerns a method of lining a metallurgical assembly.

2. Description of the Prior Art

An important problem encountered by those skilled in the art when developing a technology of lining metallurgical assemblies, e.g. induction furnaces consists in increasing stability of the lining with a simultaneous reduction of expenses required for manufacturing said lining.

The process of lining a metallurgical assembly is generally carried out as follows (see M. G. Trofimov, Futerovka induktsionnykh pechei, Moscow, "Metallurgia", 1968, pp. 129–132). First, a bottom is lined using a conventional method, following which a gauge for forming an inner wall of the future lining (a crucible) is mounted on said bottom. The space provided between the gauge and a corresponding element of the assembly, forming an outer wall of the lining (in the induction furnace this element is an induction heater) is filled with a free-flowing lining mass, e.g. with quartz sand containing binding additives. Following this the lining mass is compacted using various methods. The lining thus obtained is then sintered to increase its strength and resistance to the effect of a melt.

It should be noted that since the lining serves as a separating barrier between the melt and the cooled induction heater of the furnace, three zones having different degrees of sintering are present therein, the existence of these zones being caused by a relatively high temperature gradient in the direction of the thickness of said lining. The lining of the first zone (which is the closest to the melt) is the most sintered and the strongest one. The lining of the second (intermediate) zone, due to a lower temperature, is sintered to a lower degree than in the first zone and is less strong. In the third zone (abutting with the induction heater of the furnace) of the lining there is almost no sintering since individual grains of the refractory material are practically not bound between themselves.

In the course of lining the steps of filling and compacting the lining mass must be carried out in such a manner as to ensure:

(a) the highest degree of compaction in the first zone in order to obtain the minimum porosity and the maximum strength of the lining. These properties are necessary since the lining of this zone is to resist the effect of the melt and melting products;

(b) a lower degree of compaction in the second zone (and a higher porosity);

(c) the lowest degree of compaction in the third zone, i.e. the highest porosity since this zone is to be a buffer one, to provide for compensation of thermal expansion of the lining, and to lower impact effect exerted on said lining in the course of charging the furnace.

To increase the resistance of the lining of the assembly, the lining mass is to be uniformly compacted in the direction of the crucible height.

Moreover, in the course of lining the initial granular composition of the lining mass is to be maintained, i.e. fraction separation thereof must be eliminated.

In this connection it should be noted that the granular composition of the mass and distribution of grains over the volume of the lining mass influence the ratio between the volumes of closed and open pores and the total value of mass porosity, thereby determining numerous properties of the lining, and first of all strength and resistance to the effect of melt. The granular composition of the mass determines the number of contact points between the grains of the refractory material per unit of volume. With the optimum granular composition, voids between coarse grains are filled to the maximum extent with finer grains. The number of contact points and consequently density of the lining mass increase, thereby promoting an increase in the lining resistance.

It should be also noted that in the course of lining the local depletion or enrichment of the lining mass with a binder is to be eliminated.

With all the above requirements being met, the lining will possess high operation reliability.

In order to obtain uniform compaction of the lining mass with the crucible height, numerous prior art methods of lining provide layer-by-layer filling and compacting said mass. The step of compacting the layers is usually accomplished by ramming (USSR Inventor's Certificate No. 500,452).

The disadvantage of such a technology lies in the fact that in the course of ramming the lining mass is compacted non-uniformly along the crucible height, while along the thickness thereof the mass is uniformly compacted, due to which fact the third (buffer) zone of the lining, which must possess absorption properties, becomes excessively compacted. This results in decreasing the lining durability. Moreover, the step of ramming is a laborious and hard-to-mechanize operation, which results in a considerable increase in expenses for making the lining.

Also known in the art is a method of lining wherein, in order to obtain various properties in the direction of thickness of a lining, it has been proposed to use different lining masses and to fill them separately into a space provided between the gauge and the induction heater of the furnace, using a separating jacket (Swiss Patent Specification No. 476,272). According to this method, first the bottom of the furnace is lined, following which the gauge is mounted, and the jacket is placed between the gauge and the induction heater of the furnace, said jacket being constructed in the form of a thin-walled shell whose height does not exceed the diameter thereof. The jacket is fixed on three vertical helical rods mounted on the furnace body, said rods allowing the jacket to be either lifted or lowered relative to the bottom. The space between the gauge and the jacket and that provided between the jacket and the induction heater are filled with corresponding lining masses, the latter being subjected to compaction by ramming, shaking or vibratory compacting. In such a manner the first lining layer (in the direction of the crucible height) is formed. Following this, the jacket is lifted to a height corresponding to the thickness of the next layer, and the cycle is repeated. Using several such steps, the lining is made over the whole height of the furnace.

An obvious advantage of the above method of lining consists in the possibility of obtaining the lining having different zones with the crucible thickness, particularly two zones, and of using cheaper refractory materials for the outer (more distant from the melt) zone than those for the inner (more close to the melt) zone of lining.

In the practical realization of this method, however, there arise some serious difficulties. In particular, when compaction of the lining mass is accomplished by ramming, as required by an embodiment of the above technology, there arise difficulties similar to those accompanying the step of ramming in practicing other above described methods of lining.

When, in accordance with another embodiment of the invention, vibratory compaction is accomplished, the gauge will start vibrating and separation of the lining mass in accordance with the size of grains into separate fractions will occur, the coarse grains accumulating at the gauge. This results in an increase in the lining porosity within the first (inner) zone, thereby decreasing the resistance of the lining against the effect of the melt.

Moreover, with vibratory compacting the lining mass within the upper portion of the layer being compacted changes to a condition close to the fluidized one, which results in the local depletion or enrichment thereof with a binder and in a non-uniform compaction in the direction of crucible height. This phenomenon causes lamination of the lining and, as a sequence, penetration of the melt thereinto, which results in reducing service life of said lining.

It should be also noted that in the course of compacting the lining mass by means of various vibrators, the organism of a man carrying out lining operations is subjected to the harmful effect of vibrations.

Compaction of the lining mass, accomplished in accordance with the third embodiment of the above technology by shaking results in an increase in the total porosity of the lining (over the whole volume thereof) and as well as vibratory compaction, does not ensure uniform compaction of the mass in the direction of crucible height.

All the above difficulties inhibit wide practical application of said technology.

SUMMARY OF THE INVENTION

The principal object of the invention is to provide a method of lining a metallurgical assembly, wherein by changing the technology of compacting the lining mass there is ensured differentiated compaction thereof along the thickness and uniform compaction along the height of the crucible, thereby increasing the resistance of the crucible without augmenting expenses required for manufacturing said crucible.

The object set forth is attained by a method of lining a metallurgical assembly, comprising steps of lining an assembly bottom, mounting a gauge for forming an inner wall of the assembly lining on the lined bottom, layer-by-layer filling a space provided between the gauge and a corresponding element of the assembly forming an outer wall of the lining, with a lining mass while compacting each layer, according to the invention, the lining mass is filled in layers each having a thickness of from 4 to 10 values of said space, and compaction of each layer is accomplished by applying periodically repeating blows against the inner surface of the gauge, the direction of said blows being perpendicular to the plane tangential to this surface of the gauge, the blows being applied with an interval which is not less than the damping time of free oscillations of the assembly.

Filling the lining mass in layers each having a thickness of from 4 to 10 values of said space is the necessary condition to achieve high-quality compaction thereof.

In the case where thickness of each layer is less than fourfold size of the space, the lining turns out to be multilayer which results in a decrease in durability thereof. This fact is caused by fraction separation of said mass in the upper portion of each layer, and by accumulation of coarse grains on the surface thereof.

In the case where thickness of each layer is more that tenfold size of the space, compaction of the lining mass has a local nature and is not sufficiently complete which fact in some cases may lead to the formation of voids within the mass. Said voids also lower the lining durability.

Application of periodically repeated blows, as hereinbefore described, provides for differentiated compaction of the lining mass in the direction of crucible thickness. Since the blows are applied against the inner surface of the gauge, the lining mass is compacted to the maximum extent in the first zone being closest to the gauge, to a lesser extent in the intermediate zone, and to the lowest extent in the third (outer) zone.

The time interval of application of the blows must be not less than the damping time of free oscillations of the metallurgical assembly. Otherwise, the assembly enters the state of forced oscillations. The lining mass changes to a state being close to fluidized one, which leads to fraction separation thereof and to local depletion or enrichment with the binder.

Application points of the blows are preferably distributed over the gauge within the limits of each layer being compacted, in tiers, so that the distance between adjacent tiers and the distance between adjacent application points of blows in one tier be equal to the magnitude of a space whereto the lining mass is filled, the lower tier of application of blows be disposed at the boundaries between the layer being compacted and the previous one, and the upper tier of application of blows be located below the upper level of the layer being compacted by the value of said space, the compaction step is to be accomplished from the lower tier towards the upper one and to be repeated 3 to 5 times for each layer being compacted.

Such a distribution of application points of blows makes it possible to uniformly compact the mass in the directions of crucible height and perimeter, and inhibits fraction separation of the lining mass along the boundaries between layers being filled. The repeated nature of compaction promotes a more uniform distribution of the lining mass over the whole volume of the lining.

The above number of compaction cycles is optimum. In the case where the number of cycles exceeds 5, there may start fraction separation of the lining mass at the gauge, which will lead to an increase in the porosity of the mass within the first zone due to local accumulation of coarse fraction therewithin. This fact results in a decrease in the strength and resistance of the crucible to the effect of the melt, and in an increase in labor consumption in the course of making said crucible. In the case where the number of cycles is less than 3, there are possible cases of incomplete compaction of the lining mass within the first zone, which also reduces the strength and resistance of the lining.

To achieve a more uniform compaction of the lining mass in the directions of crucible height and perimeter with relatively large values of said space (more than 150 mm), it is expedient to shift each tier downwards with each repeated cycle of layer compaction, the value of this shift being ($\delta/N$), where $\delta$ is the size of the above space, and N is the number of compaction cycles, and to shift by the same value along the tier perimeter the application points of blows.

It is also expedient to reduce the force of blows with each repeated cycle of layer compaction so that the impulse be decreased by a magnitude of 30 to 40% within the range from $6 \cdot 10^3$ to $1.5 \cdot 10^3$ N·s.

Such a decrease in the impulse further promotes differentiated compaction of the lining mass in the direction of crucible thickness. Absorption properties of the lining are improved, cracking thereof is reduced, and resistance of said lining is upgraded.

BRIEF DESCRIPTION OF THE DRAWINGS

The present invention will be more apparent from the following embodiments thereof with reference to the accompanying drawings, in which.

DESCRIPTION OF THE PREFERRED EMBODIMENTS

Figure 1:
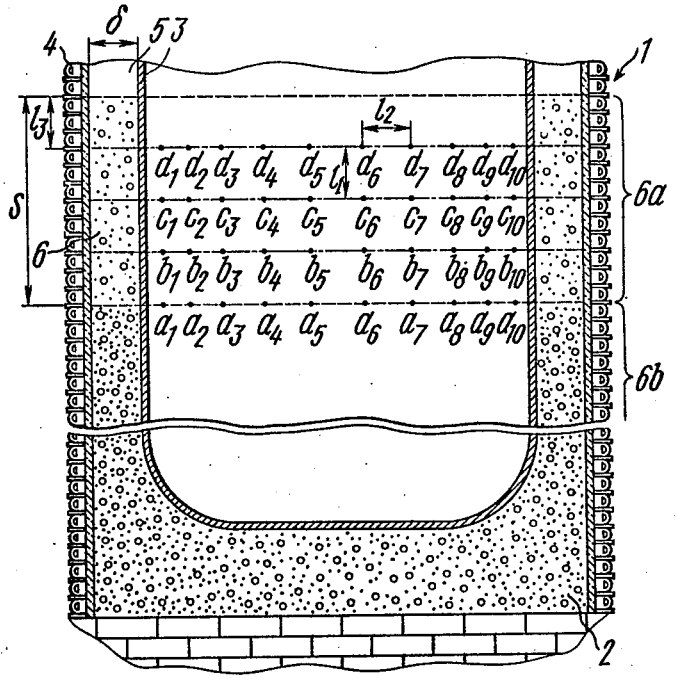
FIG. 1 shows longitudinal sectional view of a coreless induction furnace being lined in accordance with the method of the invention.

According to the invention, the process of lining a metallurgical assembly, for example a coreless induction furnace 1 (FIG. 1) is carried out as follows. First, using a conventional method, a bottom 2 of the furnace is lined (packed), following which a gauge 3 for forming an inner wall of future lining is mounted on said bottom. An induction heater 4 is the element forming an outer wall of the lining in the given furnace.

Into a space 5 provided between the insulation of the induction heater 4 and the gauge 3, lining mass 6 is filled layer-by-layer. Thickness S of each layer being filled (for example, layer 6*a*) is 4 to 10δ, where δ is the size of the space 5.

Each filled layer of the mass 6 is compacted by applying periodically repeated blows against the inner surface of the gauge 3. The blows are applied over the whole perimeter of the gauge 3 in the points $a_1 \ldots a_i$, $b_1 \ldots b_i$ etc., the direction of each blow having to be perpendicular to a conditional plane "P" which is tangential to the inner surface of the gauge 3 in a corresponding point as shown by arrows in FIG. 2 (angles α and β between the blow direction, and vertical and horizontal lines of the plane "P" are 90°).

The time interval between the blows is selected to be not less than the damping time of free oscillations of the furnace 1 (oscillations of the system "gauge-lining-induction heater").

Figure 3:
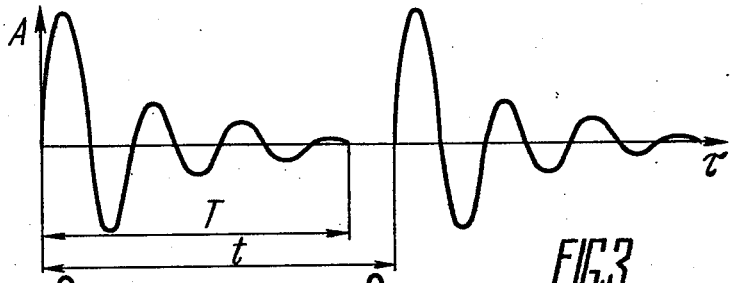
FIG. 3 illustrates, in accordance with the invention, vibrating process within the furnace lining in application of blows at an interval exceeding the damping time of free oscillations of the furnace.
Figure 4:
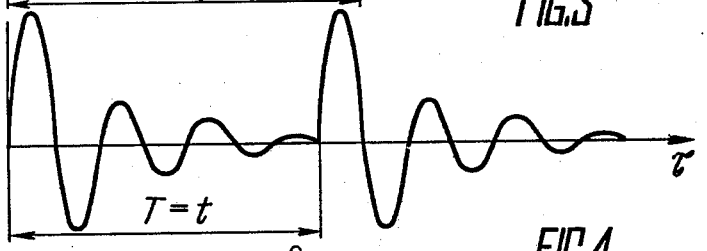
FIG. 4 shows the view similar to that of FIG. 3 in the case where the interval between the blows is equal to the damping time of free oscillations of the furnace.
Figure 5:
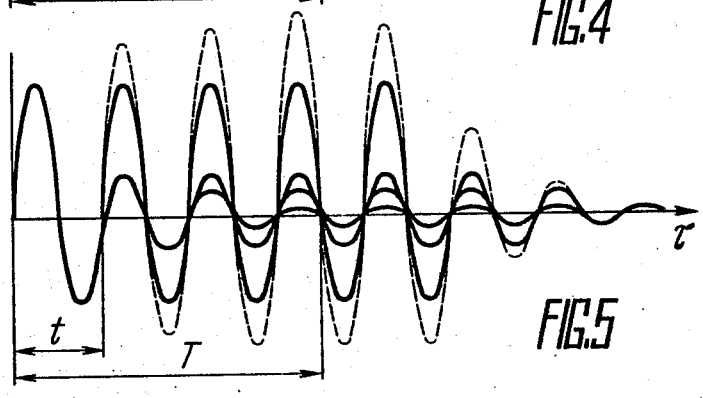
FIG. 5 shows the view similar to that of FIG. 3 in the case when the interval between the blows is less than the damping time of free oscillations of the furnace.

Now consider in more detail the vibrating process of this system, shown in diagrams of FIGS. 3 through 5, wherein time (τ) is plotted along the axis of abscissae, and amplitude (A) of oscillations, along the Y-axis.

In the case where the blows are applied with an interval t, exceeding or equal to the damping time T of free oscillations of the system, as shown respectively in FIGS. 3 and 4, then the desired compaction of the lining mass, which is differentiated by zones, is achieved. In so doing, the mass is uniformly compacted in the directions of height and perimeter of the future crucible.

If the interval t is less than the time T (FIG. 5), the induction furnace enters the state of forced (undamped) oscillations, that is when the furnace oscillations caused by a previous blow have not yet damped, the oscillations caused by the next blow start. In this case there occurs mutual superposition of oscillations, and the resulting vibrating process is characterized in the particular case (in the coincidence of oscillation phases) by a curve which is shown in a dotted line in FIG. 5. In this case the lining mass in the upper portion of the layer being compacted changes to a state close to the fluidized one, in which state there occurs its fraction separation and local depletion or enrichment with a binder, thereby reducing the lining resistance.

It should be noted that, since in order to increase the lining productivity the interval t between the blows must be as short as possible, this interval is to be selected to slightly exceed (by 1 to 1.5 s) the time T.

It is advantageous to distribute the application points of blows over the gauge 3 (FIG. 1) within the limits of each layer 6*a* being compacted, in tiers $a_1, a_2 \ldots a_i$, $b_1, b_2 \ldots b_i$, $c_1, c_2 \ldots c_i$, $d_1, d_2 \ldots d_i$ so that the distance $l_1$ between adjacent tiers (e.g. between the tier "c" and the tier "d") and the distance $l_2$ between adjacent points of one tier (e.g. between the points $d_6$ and $d_7$) be equal to the value δ of the space 5. The lower tier "a" is disposed at the boundary between the layer 6*a* being compacted and the previous layer 6*b*, and the upper tier "d" is located below the upper level of the layer 6*a* by a value $l_3$ which is equal to the value δ of the space 5. Compaction is carried out from the bottom upwards from the tier "a" to the tier "d", and is repeated 3 to 5 times for each layer being compacted.

Such an application of blows promotes the uniform distribution of the lining mass 6 over the whole volume of the space 5 between the gauge 3 and the induction heater 4, and uniform compaction thereof both over perimeter and height of the furnace crucible being formed, and inhibits fraction separation of the mass 6 along the boundaries between the layers.

Figure 6:
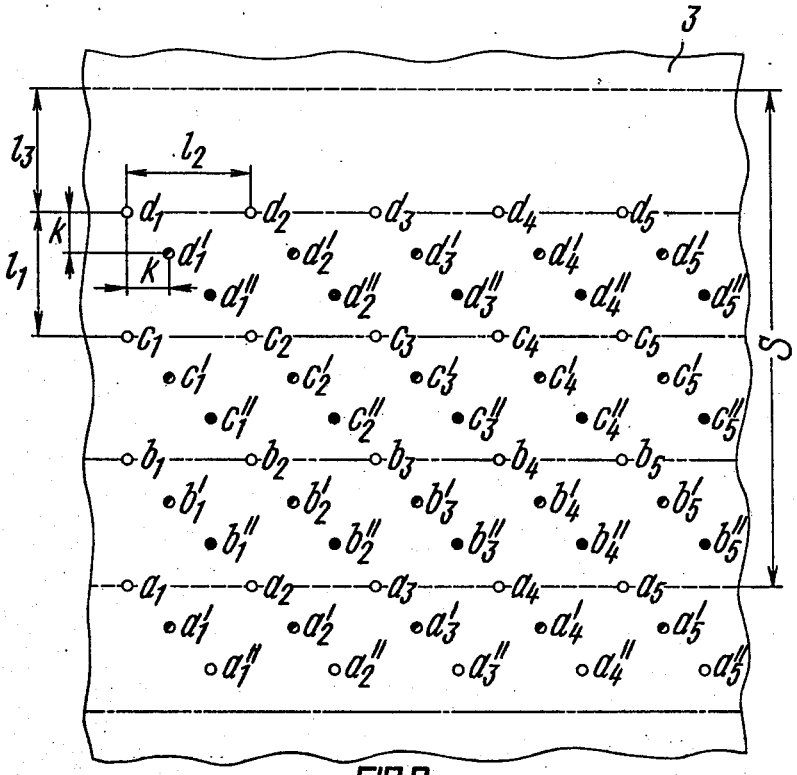
FIG. 6 shows the scheme of distribution of application points of blows over the gauge surface with several cycles of compaction of lining mass layers in accordance with the method of the invention.

In the case where the value δ of the space 5 in a metallurgical assembly reaches a comparatively large value (more than 150 mm), then in order to increase the compaction uniformity of the lining mass in the direction of crucible height it is recommended to apply blows as shown in FIG. 6. In this case with each repeated compaction cycle, each tier is shifted downwards by a value "K" being of (δ/N), where δ is the size of the space 5, and N is a selected number of compaction cycles, the application points of blows being shifted over the tier perimeter by the same value "K". Thus, in the first compaction, blows are applied against the gauge 3 in the points $a_1 \ldots a_i$, $b_1 \ldots b_i$, $c_1 \ldots c_i$, $d_1 \ldots d_i$ (which are designated by light circles for the illustrative purpose); in the second compaction the blows are applied in the points $a_1' \ldots a_i'$, $b_1' \ldots b_i'$, $c_1' \ldots c_i'$, $d_1' \ldots d_i'$ (semi-blackened circles); and in the third compaction in the points $a_1'' \ldots a_i''$, $b_1'' \ldots b_i''$, $c_1'' \ldots c_i''$, $d_1'' \ldots d_i''$ (dark circles) etc.

In practicing the inventive method, the best results are achieved in the case where with each repeated compaction cycle the force of blows is so reduced that the impulse be decreased by the value of from 30 to 40% within the limits of $6 \cdot 10^3$ to $1.5 \cdot 10^3$ N·s. This fact further promotes differentiated compaction of the lining mass 6 (FIG. 1) within the space 5, thereby improving damping properties of the assembly lining and upgrading the resistance thereof.

In the event that within the furnace lining is mounted a monitoring device, e.g. a light conducting block 7 (FIG. 7) for transmission of the thermal radiation from the melt to a pyrometer (not shown), said block being disposed horizontally in such a manner that one end thereof contacts the gauge 3, while the other end extends outwards through an opening provided in the induction heater 4 of the furnace 1, the process of compacting the lining mass 6 is carried out as follows.

The layer of the mass 6 wherein the light conducting block 7 is disposed, is compacted in several cycles by means of blows against the gauge 3 (see also FIG. 8) in a manner described above (the application points of blows of the last cycle are designated by light circles $a_6 \ldots a_{10}$, $b_6 \ldots b_{10}$ etc.) except for a zone being directly adjacent the light conducting block 7. This zone of the gauge 3 is defined by a circle being concentric to an end face 7*a* of the light conducting block 7, and is designated in FIG. 8 by semi-blackened and dark circles $f_1$, $f_1'$ etc. The radius R of said circle is equal to $\delta+(m/2)$, where $\delta$ is the size of the space 5 (FIG. 1), m is the maximum transverse dimension of the monitoring device (in the given case being the diameter of the light conducting block 7).

Figure 8:
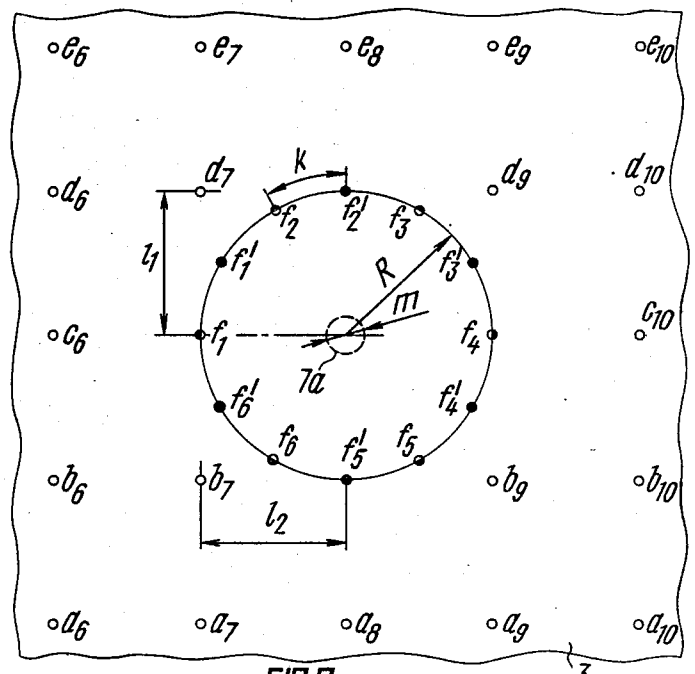
FIG. 8 shows the diagram of distribution of application points of blows over the gauge surface for the case specified for FIG. 7.
Figure 7:
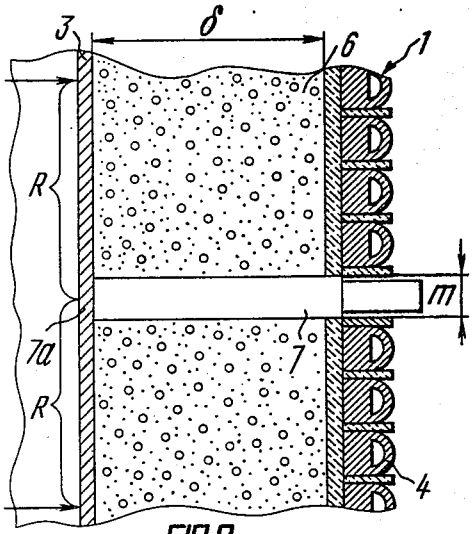
FIG. 7 shows schematically the process of compacting the lining mass in accordance with the invention in the case of location of a monitoring device within the furnace lining.

Said zone starts to be compacted after the last cycle of compaction of the main portion of a layer of the mass 6 is over, said compaction being carried out by blows whose direction is shown by the arrows in FIG. 7, against the points $f_1, f_2 \ldots f_6$ of the circle, shown in FIG. 8.

Compaction of said zone may be also carried out in several cycles, the starting force of blows being selected the same as in the last cycle of compaction of the main portion of the layer of mass 6, i.e. having the minimum magnitude, following which said force is reduced during each cycle by 30 to 40%. In this case the application points of blows are shifted along the circle with each cycle by the same value "K" being equal to ($\delta$/N), which has been above described in detail. FIG. 8 illustrates a particlar case where compaction of said zone is carried out in two cycles, the points $f_1 \ldots f_6$ corresponding to the first cycle, (semi-blackened circles), while the points $f_1' \ldots f_6'$ (dark circles) correspond to the second cycle.

The process of compacting said zone is carried out till the light conducting block 7 (FIG. 7) stops turning about the axis thereof within the lining mass 6. Such a technology of compacting the lining mass 6 in the zone of location of the light conducting block 7 cannot cause the damage of the latter and at the same time ensures reliable fixation and operation thereof within the lining of the furnace 1, and also eliminates the possibility of break-through of the melt through the crucible in this zone.

It should be noted that the above described method of lining a metallurgical assembly can be practiced by means of relatively simple devices and mechanisms, due to which fact the process of lining may be easily mechanized. Moreover, the proposed technology of compacting the lining mass 6 eliminates the effect of harmful vibrations on the human organism since any frequency of application of blows against the gauge 3 can be selected, the single condition consisting in that the interval between these blows be not less than the damping time of free oscillations of the assembly.

The invention is further explained in terms of specific examples of lining a metallurgical assembly, in particular an induction furnace, according to the inventive method.

EXAMPLE 1

The process of lining a coreless induction furnace having a capacity of 6 t, was carried out as follows.

Next to lining a bottom and mounting a gauge, said steps being carried out in a conventional manner, a lining mass consisting from quartzite and required binding additives was filled layer-by-layer in a space provided between the gauge and an insulation of an induction heater. The size of the space ($\delta$) was 150 mm, and the thickness of each layer of the mass (S) was 600 mm.

Figure 2:
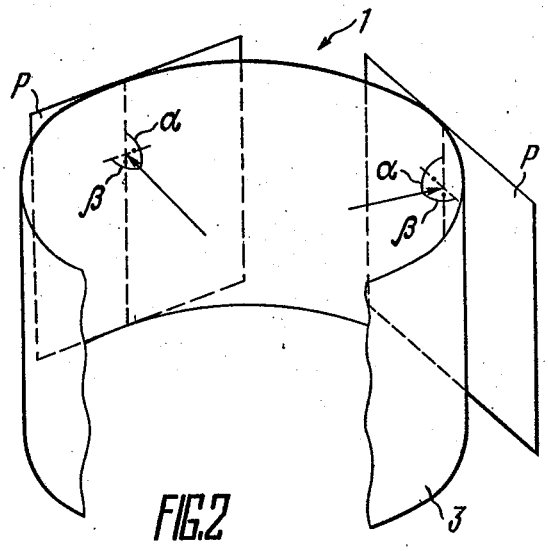
FIG. 2 shows an axonometric diagram of application of blows against the furnace gauge in accordance with the proposed method of lining (the arrows show directions of application of blows)

In accordance with the inventive method, each filled layer of the mass was compacted by applying blows against the inner surface of the gauge in the direction perpendicular to the plane P (FIG. 2). The blows were applied with an interval (t) being of 2 s. The time (T) of damping free oscillations of the furnace was 1 s. The application points of blows against the gauge were distributed in tiers within the limits of each layer being compacted. The distance between adjacent tiers and the distance between adjacent application points of blows of one tier were of 150 mm. The lower tier was located at the boundary between the layer being compacted and the previous one, and the upper tier was disposed below the upper level of the layer by a distance of 150 mm.

Each layer was compacted 3 times (N), the force of blows being reduced with each subsequent time in such a way that the impulse (I) was decreased by the value of 40% ($\Delta$) and was correspondingly: $I_1=6 \cdot 10^3$ N·s; $I_2=3.6\ 10^3$ N·s; $I_3=2.2 \cdot 10^3$ N·s.

The lining thus compacted and then sintered operated satisfactorily during the reference period (1,000 h). Subsequent analysis of the lining demonstrated that the granular composition thereof was uniform both in thickness and height directions of the crucible, the lining having three clearly defined concentric zones: the first zone (being in contact with the melt) was the most sintered and saturated with melting products (the most metallized); the second zone (intermediate) was less sintered, less strong and more porous. In the third zone the grains of the refractory material were not bound therebetween, the greatest, and the density was the lowest, thereby rendering this zone damping properties. Due to this fact the break-through of the melt from the crucible outside the furnace was eliminated.

EXAMPLE 2

The process of lining the furnace was carried out mainly as described in Example 1.

Some process parameters were changed to the following values:

S—900 mm
t—1.5 s
N—4
Δ—35%
$I_1$—$6 \cdot 10^3$ N·s
$I_2$—$3.9 \cdot 10^3$ N·s
$I_3$—$2.5 \cdot 10^3$ N·s
$I_4$—$1.6 \cdot 10^3$ N·s The lining thus obtained operated satisfactorily during the whole reference period. In addition, the depth of the lining metallization was less than in Example 1, thereby increasing resistance thereof to the effect of the melt.

EXAMPLE 3

The process of lining the furnace was carried out mainly as described in Example 1.

Some process parameters were changed to the following values:

S—1,200 mm
N—5
Δ—30%
$I_1$—$6.0 \cdot 10^3$ N·s
$I_2$—$4.2 \cdot 10^3$ N·s
$I_3 \cdot 2.9 \cdot 10^3$ N·s
$I_4$—$2 \cdot 10^3$ N·s
$I_5$—$1.4 \cdot 10^3$ N·s The lining thus obtained operated satisfactorily during the whole reference period. In addition, the depth of the lining metallization was less than in Example 2.

EXAMPLE 4

The process of lining the furnace was carried out mainly as described in Example 1.

Some process parameters were changed to the following values:

S—1,500 mm
N—3
Δ—40%
$I_1$—$6.0 \cdot 10^3$ N·s
$I_2$—$3.6 \cdot 10^3$ N·s
$I_3$—$2.2 \cdot 10^3$ N·s The lining thus obtained operated satisfactorily during the whole reference period.

EXAMPLE 5

The process of a coreless induction furnace having a capacity of 10 t was carried out mainly as described in Example 1. The space between the insulation of the induction heater and the gauge was of 170 mm, and the damping time of free oscillations was of 1.2 s. As against Example 1, some process parameters were changed to the following values:

S—1,360 mm
N—5
Δ—40%
$I_1$—$6.0 \cdot 10^3$ N·s
$I_2$—$3.6 \cdot 10^3$ N·s
$I_3$—$2.2 \cdot 10^3$ N·s
$I_4$—$1.9 \cdot 10^3$ N·s
$I_5$—$1.1 \cdot 10^3$ N·s The lining thus obtained operated satisfactorily during the whole reference period.

EXAMPLE 6

The process of lining a furnace was carried out mainly as described in Example 1. Some process parameters were changed to the following values:

S—1,200 mm
N—10
Δ—10%
$I_1$—$6.0 \cdot 10^3$ N·s
$I_2$—$5.4 \cdot 10^3$ N·s
$I_3$—$4.9 \cdot 10^3$ N·s
$I_4$—$4.4 \cdot 10^3$ N·s
$I_5$—$4.0 \cdot 10^3$ N·s
$I_6$—$3.6 \cdot 10^3$ N·s
$I_7$—$3.2 \cdot 10^3$ N·s
$I_8$—$2.9 \cdot 10^3$ N·s
$I_9$—$2.6 \cdot 10^3$ N·s
$I_{10}$—$2.3 \cdot 10^3$ N·s The lining thus obtained operated satisfactorily. However due to the fact that the number of compaction cycles exceeded the recommended one, damping properties of said lining were lower than those in Example 1. This resulted in crack formation in some places of the lining, through which cracks the melt penetrated thereinto. In some regions there occurred accumulation of coarse fraction of the lining mass at the gauge surface and along the boundaries between filled layers, thereby resulting in an increase in the porosity and metallization depth of the lining in these places.

EXAMPLE 7

The process of lining a furnace was carried out mainly as described in Example 1. In the course of repeated compaction the blows were so applied that the impulse value decreased by 50% (Δ), the magnitude of the impulse decrease was below the recommended value. Other process parameters were changed to the following values:

S—900 mm
N—3
$I_1$—$3.0 \cdot 10^3$ N·s
$I_2$—$1.5 \cdot 10^3$ N·s
$I_3$—$0.7 \cdot 10^3$ N·s The lining thus obtained operated satisfactorily, though the porosity in the first zone thereof was higher than that in Example 1, thereby resulting in an increase in the metallization depth of the lining.

EXAMPLE 8

The process of lining a furnace was carried out mainly as described in Example 1. Blows were applied in five cycles in such a manner that the impulse in the first two compaction cycles exceeded the recommended value and was:

$I_1$—$10 \cdot 10^3$ N·s
$I_2$—$7 \cdot 10^3$ N·s

Other process parameters were changed to the following values:

S—1,200 mm
Δ—30%
$I_3$—$5 \cdot 10^3$ N·s
$I_4$—$3.5 \cdot 10^3$ N·s
$I_5$—$2.5 \cdot 10^3$ N·s The lining thus obtained operated satisfactorily, though its granular composition was non-uniform in some places in the direction of the crucible thickness, and damping properties were lower than those in Example 1, thereby resulting in an increase in the metallization depth of the lining.

EXAMPLE 9

The process of lining a furnace was carried out mainly as described in Example 1. The value (δ) of the space provided between the gauge and the insulation of the induction heater was 180 mm. The number (N) of compaction cycles of the lining mass and the impulse values in each cycle were the same as in the above Example. Each tier of blow application was shifted downwards with each repeated cycle along the gauge by a distance of 60 mm (δ/N), the application points of blows being shifted along the tier perimeter by the same distance (FIG. 6).

In spite of a significant size of the above space, the lining thus obtained operated satisfactorily during the whole reference period.

EXAMPLE 10

The process of lining a furnace was carried out mainly as described in Example 1. The value (δ) of the space provided between the gauge and the insulation of the induction heater was 300 mm. The number (N) of compaction cycles of the lining mass and the impulse values in each cycle were the same as those in Example 3. Each tier of blow application was shifted downwards with each repeated compaction cycle along the gauge by a distance of 60 mm (δ/N), the application points of blows being shifted along the tier perimeter by the same distance (FIG. 6).

In spite of a significant size of the above space, the lining thus obtained operated satisfactorily during the whole reference period.

EXAMPLE 11 (NEGATIVE)

The process of lining a furnace was carried out mainly as described in Example 1. The thickness of each layer of the lining mass being filled was less than the recommended value and was of 150 mm. Other process parameters were changed to the following values:

t—1 s
N—3
Δ—40%
$I_1$—$6.0 \cdot 10^3$ N·s
$I_2$—$3.2 \cdot 10^3$ N·s
$I_3$—$2.2 \cdot 10^3$ N·s The granular compositions of the lining thus obtained was nonuniform in the direction of the crucible height, due to which fact along the boundaries of the filled layers there was observed a local metallization of the lining to a considerable depth, thereby causing the danger of break-through of the melt from the crucible and beyond the furnace.

EXAMPLE 12 (NEGATIVE)

The process of lining a furnace was carried out mainly as described in Example 1. The thickness of the filled layer was more than that recommended, of 2,000 mm. Other process parameters were changed to the following values:

N—4
Δ—35%
$I_1$—$6.0 \cdot 10^3$ N·s
$I_2$—$3.9 \cdot 10^3$ N·s
$I_3$—$2.5 \cdot 10^3$ N·s
$I_4$—$1.6 \cdot 10^3$ N·s The lining thus obtained had considerable local unsoundness, due to which fact the melt penetrated thereinto to a relatively large depth (to the third, buffer zone). This caused the danger of break-through of the melt from the crucible and beyond the furnace.

EXAMPLE 13 (NEGATIVE)

The process of lining a furnace was carried out mainly as described in Example 1. The blows were applied at an interval of 0.3 s. Other process parameters were changed to the following values:

S—900 mm
I—6.0·10 N·s

Due to the fact that in the course of lining the interval between the blows was shorter than the recommended one, the "gauge-lining-induction heater" system was in the state of forced oscillations, and the lining mass passed to a state close to the fluidized one. This caused depletion in one places, and enrichment in others of the lining mass with a binding agent, and fraction separation of said mass. The melt penetrated into the lining to a considerable depth, thereby causing the danger of the melt break-through from the crucible and beyond the furnace.

While particular embodiments of the inventive method of lining have been shown and described, various modifications thereof will be apparent to those skilled in the art and therefore it is not intended that the invention be limited to the disclosed embodiments or to the details thereof and the departures may be made therefrom within the spirit and scope of the invention as defined in the appended claims.

INDUSTRIAL APPLICABILITY

The invention may prove most advantageous when carrying out rammed lining within coreless induction furnaces. In addition, it may be applied in lining metallurgical and foundry assemblies of other types.

What is claimed is:

1. A method of lining a metallurgical assembly, comprising steps of lining an assembly bottom, mounting a gauge for forming an inner wall of the assembly lining on the lined bottom, layer-by-layer filling a space provided between the gauge and a corresponding element of the assembly forming an outer wall of the lining, with a lining mass while compacting each layer, wherein the lining mass (6) is filled in layers each having a thickness of from 4 to 10 values of said space (5), and compaction of each layer is accomplished by applying periodically repeating blows against the inner surface of the gauge (3), the direction of said blows being perpendicular to the plane tangential to this surface of the gauge (3), the blows being applied with an interval which is not less than the damping time of free oscillations of the assembly (1).

2. A method as set forth in claim 1, wherein application points of blows are distributed over the gauge (3) within each layer being compacted and in tiers ($a_1 \ldots a_i$, $b_1 \ldots b_i$, $c_1 \ldots c_i$, $d_1 \ldots d_i$) so that the distance between adjacent tiers and the distance between adjacent application points of blows of one tier are equal to the size of the space (5) whereto the lining mass (6) is filled, the lower tier ($a_1 \ldots a_i$) of application of blows being located along the boundary between the layer being compacted (6*a*) and the previous one (6*b*), and the upper tier ($d_1 \ldots d_i$) of application of blows is disposed below the upper level of the layer being compacted (6*a*) by the size of said space (5), the step of compaction being carried out from the lower tier ($a_1 \ldots a_i$) to the upper one ($d_1 \ldots d_i$), and repeated 3 to 5 times for each layer being compacted.

3. A method as set forth in claim 2, wherein with each repeated cycle of compaction of the layer (6*a*), each tier ($a_1 \ldots a_i$, $b_1 \ldots b_i$, $c_1 \ldots c_i$, $d_1 \ldots d_i$) is shifted downwards to a value of ($\delta/N$), where $\delta$ is the size of said space (5), and N is the number of compaction cycles, application points of blows being shifted by the same value along the tier perimeter.

4. A method as set forth in claim 2, wherein with each repeated cycle of compaction of the layer (6*a*) the force of blows is reduced so that the impulse be decreased by 30 to 40% within the range of $6 \cdot 10^3$ to $1.5 \cdot 10^3$ N·s.

5. A method as set forth in claim 3, wherein with each repeated cycle of compaction of the layer (6*a*) the force of blows is reduced so that the impulse be decreased by 30 to 40% within the range of $6 \cdot 10$ to $1.5 \cdot 10^3$ N·s.

* * * * *